US011021947B2

(12) United States Patent
Ratcliffe et al.

(10) Patent No.: US 11,021,947 B2
(45) Date of Patent: Jun. 1, 2021

(54) SENSOR BRACKET POSITIONED ON A MOVABLE ARM SYSTEM AND METHOD

(71) Applicant: Sondex Wireline Limited, Farnborough (GB)

(72) Inventors: James David Ratcliffe, Farnborough (GB); Timothy Michael Gill, Farnborough (GB); Neil Geoffrey Harris, Farnborough (GB); Ian Hitchcock, Farnborough (GB)

(73) Assignee: SONDEX WIRELINE LIMITED, Farnborough (GB)

( * ) Notice: Subject to any disclaimer, the term of this patent is extended or adjusted under 35 U.S.C. 154(b) by 76 days.

(21) Appl. No.: 16/013,407

(22) Filed: Jun. 20, 2018

(65) Prior Publication Data

US 2018/0363449 A1 Dec. 20, 2018

Related U.S. Application Data

(60) Provisional application No. 62/522,351, filed on Jun. 20, 2017.

(51) Int. Cl.
*E21B 47/01* (2012.01)
*E21B 17/10* (2006.01)

(52) U.S. Cl.
CPC ..... *E21B 47/01* (2013.01); *E21B 17/1021* (2013.01)

(58) Field of Classification Search
CPC ..... E21B 47/01; E21B 17/026; E21B 23/14; E21B 17/1021; E21B 49/08
See application file for complete search history.

(56) References Cited

U.S. PATENT DOCUMENTS

| | | | | |
|---|---|---|---|---|
| 3,076,334 | A * | 2/1963 | Wilcy | G01F 1/103 73/152.26 |
| 4,184,546 | A | 1/1980 | Nicolas et al. | |
| 4,673,890 | A | 6/1987 | Copland | |
| 4,715,440 | A | 12/1987 | Boxell et al. | |
| 4,926,937 | A | 5/1990 | Hademenos | |
| 5,086,645 | A | 2/1992 | Deaton | |

(Continued)

FOREIGN PATENT DOCUMENTS

| | | |
|---|---|---|
| CN | 201090208 | 7/2008 |
| WO | 2016137462 | 9/2016 |
| WO | 2016/159780 | 10/2016 |

OTHER PUBLICATIONS

"MaxTRAC Downhole Wireline Tractor System," 2018, Schlumberger Limited, https://www.slb.com/services/ production/production_logging/conveyance/maxtrac_downhole_well_tractor.aspx.

(Continued)

*Primary Examiner* — Tara Schimpf
*Assistant Examiner* — Jonathan Malikasim
(74) *Attorney, Agent, or Firm* — Hogan Lovells US LLP

(57) ABSTRACT

A system for positioning a sensor within a flow path of a wellbore annulus includes a work string extending into the wellbore annulus from a surface location. The system includes a movable arm on the work string, the arm transitioning between a first radial location and a second radial location. The system further includes a bracket coupled to the arm, the bracket being pivotable about a pivot axis, wherein the bracket supports the sensor and transitions the sensor from a stored position to a deployed position.

19 Claims, 7 Drawing Sheets

(56) References Cited

U.S. PATENT DOCUMENTS

| | | | | |
|---|---|---|---|---|
| 5,092,056 | A | 3/1992 | Deaton | |
| 5,092,423 | A * | 3/1992 | Petermann | E21B 17/1021 181/102 |
| 5,548,900 | A | 8/1996 | Hunt-Grubbe | |
| 5,574,263 | A | 11/1996 | Roesner | |
| 6,176,129 | B1 | 1/2001 | Aguesse | |
| 6,454,030 | B1 * | 9/2002 | Findley | B22F 7/06 175/425 |
| 6,560,889 | B1 * | 5/2003 | Lechen | E21B 47/08 33/542.1 |
| 6,629,568 | B2 | 10/2003 | Post et al. | |
| 6,910,533 | B2 | 6/2005 | Guerrero | |
| 6,920,936 | B2 | 7/2005 | Sheiretov et al. | |
| 7,114,386 | B1 | 10/2006 | Veignat et al. | |
| 7,281,578 | B2 | 10/2007 | Nakajima et al. | |
| 7,293,746 | B2 | 11/2007 | Brundage | |
| 7,334,642 | B2 | 2/2008 | Doering et al. | |
| 7,543,512 | B2 * | 6/2009 | Smith | E21B 47/01 73/865.8 |
| 7,694,735 | B2 | 4/2010 | Haheim et al. | |
| 7,954,563 | B2 | 6/2011 | Mock et al. | |
| 8,453,744 | B2 | 6/2013 | Buss | |
| 8,579,037 | B2 | 11/2013 | Jacob | |
| 9,051,823 | B2 | 6/2015 | Maute | |
| 9,097,100 | B2 | 8/2015 | Finke | |
| 9,181,796 | B2 | 11/2015 | Malone | |
| 9,303,478 | B2 | 4/2016 | Scruggs | |
| 9,915,144 | B2 * | 3/2018 | Manzar | E21B 47/102 |
| 2005/0145415 | A1 | 7/2005 | Doering | |
| 2006/0230846 | A1 | 10/2006 | Smith | |
| 2009/0093692 | A1 | 4/2009 | Hansma | |
| 2011/0127046 | A1 | 6/2011 | Aguirre | |
| 2011/0138903 | A1 | 6/2011 | Large | |
| 2013/0068479 | A1 | 3/2013 | Aldossary | |
| 2014/0352422 | A1 | 12/2014 | Paulsson | |
| 2015/0211312 | A1 | 7/2015 | Krueger | |
| 2016/0130935 | A1 | 5/2016 | Manzar | |

OTHER PUBLICATIONS

"Multiple Array Production Suite," 2018, General Electric, https://www.geoilandgas.com/oilfield/wireline-technology/multiple-array-production-suite.

International Search Report and Written Opinion dated Sep. 27, 2018 in corresponding PCT Application No. PCT/US2018/038561.

International Search Report and Written Opinion dated Oct. 19, 2018 in corresponding PCT Application No. PCT/US2018/038592.

Office Action dated Nov. 4, 2019 in corresponding U.S. Appl. No. 16/013,391.

Office Action dated Nov. 4, 2019 in corresponding U.S. Appl. No. 16/013,320.

* cited by examiner

SENSOR BRACKET POSITIONED ON A MOVABLE ARM SYSTEM AND METHOD

CROSS REFERENCE TO RELATED APPLICATION

This application claims priority to and the benefit of U.S. Provisional Application Ser. No. 62/522,351 filed Jun. 20, 2017, titled "SENSOR BRACKET SYSTEM AND METHOD," the full disclosure of which is hereby incorporated herein by reference in its entirety for all purposes.

BACKGROUND

1. Field of Invention

This disclosure relates in general to oil and gas tools, and in particular, to systems and methods for sensor configurations in downhole logging tools.

2. Description of the Prior Art

In oil and gas production, various measurements are conducted in wellbores to determine characteristics of a hydrocarbon producing formation. These measurements may be conducted by sensors that are carried into the wellbore on tubulars, for example, drilling pipe, completion tubing, logging tools, etc. Multiple measurements may be performed along different locations in the wellbore and at different circumferential positions. Often, the number of measurements leads to the deployment of several downhole tools, thereby increasing an overall length of the string, which may be unwieldy or expensive. Further, arranging sensors to conduct the measurements along the tubulars may negatively impact the measurement because the sensor may not be properly arranged within a flow stream.

SUMMARY

Applicant recognized the problems noted above herein and conceived and developed embodiments of systems and methods, according to the present disclosure, for sensor deployment systems.

In an embodiment, a system for positioning a sensor within a flow path of a wellbore annulus includes a work string extending into the wellbore annulus from a surface location. The system also includes a moveable arm on the work string, the arm transitioning between a first position at a first radial location and a second position at a second radial location, the first radial location being closer to a tool string axis than the second radial location. The system further includes a bracket coupled to the arm, the bracket being pivotable about a pivot axis substantially perpendicular to the tool string axis, wherein the bracket supports the sensor and transitions the sensor from a stored position to a deployed position when the arm moves to the second radial location.

In another embodiment, a system for mounting a sensor to an arm of a downhole tool includes a first finger extending from a first end to a second end, a second finger extending from the first end to the second end and parallel to the first finger, a base coupling the first finger to the second finger, and a holster coupled to at least one of the first finger or the second finger, the holster having a void space for receiving at least a portion of the sensor and positioning the sensor along a holster axis.

In an embodiment, a system for securing a sensor to a downhole tool includes an arm forming at least a portion of the downhole tool, the arm being movable between a stored position at a first radial position and an extended position at a second radial position, wherein the first radial position is closer to a tool string axis than the second radial position. The system also includes a bracket secured to the arm at a pivot axis, the bracket being rotatable about the pivot axis between a first position and a second position, the bracket comprising a holster having a void region for receiving the sensor, the holster positioning the sensor along a holster axis. Additionally, the holster axis is substantially parallel to the tool string axis when the holster is in the first position and the holster axis is arranged at an angle relative to the tool string axis when the holster is in the second position.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
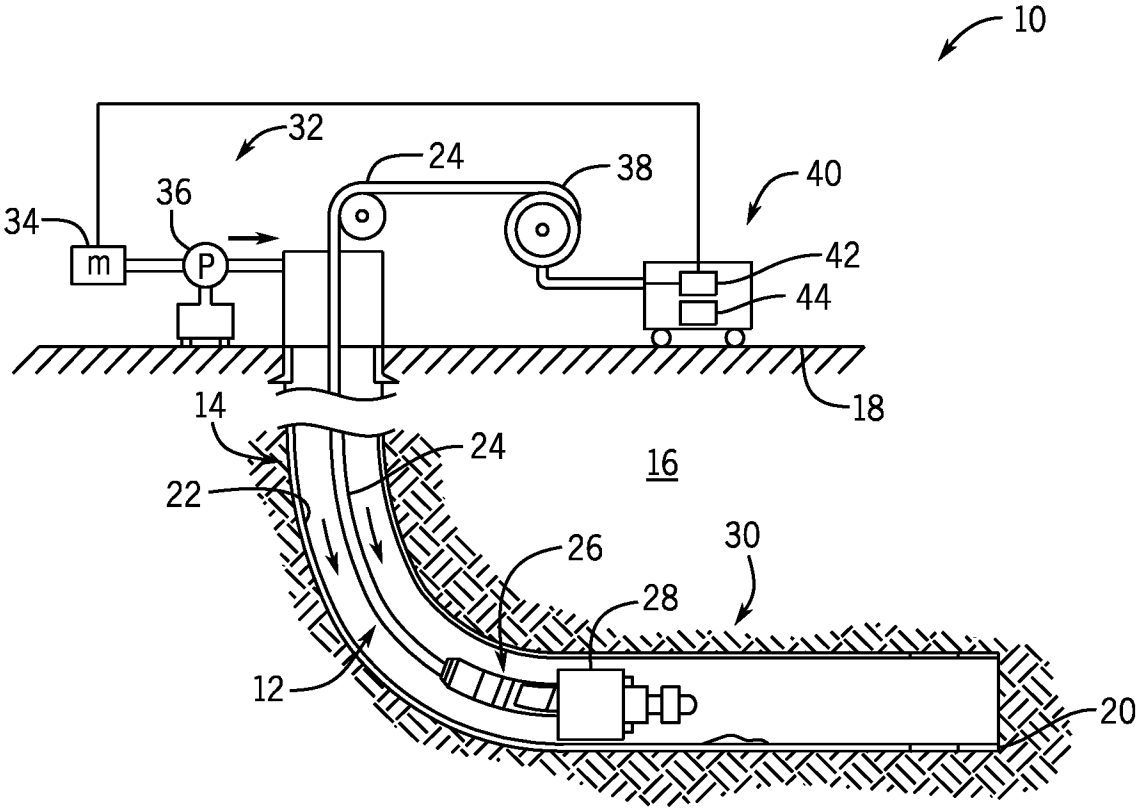
FIG. 1 is a schematic elevation view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include systems and methods to perform downhole measurements in oil and gas formations. In certain embodiments, a downhole tool includes a plurality of extendable arms to arrange one or more sensors in a wellbore annulus to measure one or more characteristics of fluid (e.g., gas, liquid, solid, or a combination thereof) flowing through the annulus. The extendable arms may include a bracket to position the sensors outwardly from a body of the tool and into a flow path. In embodiments, the bracket is rotatable about an axis to enable rotational movement relative to movement of the extendable arms. That is, as the extendable arms are moved radially outward from the body, the bracket may pivot about the axis to position the sensors in the flow path. In certain embodiments, the bracket is configured to hold two different sensors, thereby enabling a larger number of sensors to be positioned on the tool and potentially reducing the length of the logging tools utilized in the well.

FIG. 1 is a schematic elevation view of an embodiment of a wellbore system 10 that includes a work string 12 shown conveyed in a wellbore 14 formed in a formation 16 from a surface location 18 to a depth 20. The wellbore 14 is shown lined with a casing 22, however it should be appreciated that in other embodiments the wellbore 14 may not be cased. In various embodiments, the work string 12 includes a conveying member 24, such as an electric wireline, and a downhole tool or assembly 26 (also referred to as the bottomhole assembly or "BHA") attached to the bottom end of the wireline. The illustrated downhole assembly 26 includes various tools, sensors, measurement devices, communication devices, and the like, which will not all be described for clarity. In various embodiments, the downhole assembly 26 includes a downhole tool 28 having extendable arms, which will be described below, for positioning one or more sensors into the annulus of the wellbore 14. In the illustrated embodiment, the downhole tool 28 is arranged in a horizontal or deviated portion 30 of the wellbore 14, however it should be appreciated that the downhole tool 28 may also be deployed in substantially vertical segments or the wellbore 14.

The illustrated embodiment further includes a fluid pumping system 32 at the surface 18 that includes a motor 34 that drives a pump 36 to pump a fluid from a source into the wellbore 14 via a supply line or conduit. To control the rate of travel of the downhole assembly, tension on the wireline 14 is controlled at a winch 38 on the surface. Thus, the combination of the fluid flow rate and the tension on the wireline may contribute to the travel rate or rate of penetration of the downhole assembly 16 into the wellbore 14. The wireline 14 may be an armored cable that includes conductors for supplying electrical energy (power) to downhole devices and communication links for providing two-way communication between the downhole tool and surface devices. In aspects, a controller 40 at the surface is provided to control the operation of the pump 36 and the winch 38 to control the fluid flow rate into the wellbore and the tension on the wireline 12. In aspects, the controller 40 may be a computer-based system that may include a processor 42, such as a microprocessor, a storage device 44, such as a memory device, and programs and instructions, accessible to the processor for executing the instructions utilizing the data stored in the memory 44.

In various embodiments, the downhole tool 28 may include extendable arms that include one or more sensors attached thereto. The arms enable the sensors to be arranged within the annulus, which may be exposed to a flow of fluid that may include hydrocarbons and the like moving in an upstream direction toward the surface 18. In various embodiments, the arms enable a reduced diameter of the downhole tool 28 during installation and removal procedures while still enabling the sensors to be positioned within the annulus, which may provide improved measurements compared to arranging the sensors proximate the tool body. As will be described below, in various embodiments the sensors may be communicatively coupled to the controller 40, for example via communication through the wireline 24, mud pulse telemetry, wireless communications, wired drill pipe, and the like. Furthermore, it should be appreciated that while various embodiments include the downhole tool 28 incorporated into a wireline system, in other embodiments the downhole tool 28 may be associated with rigid drill pipe, coiled tubing, or any other downhole exploration and production method.

Figure 2:
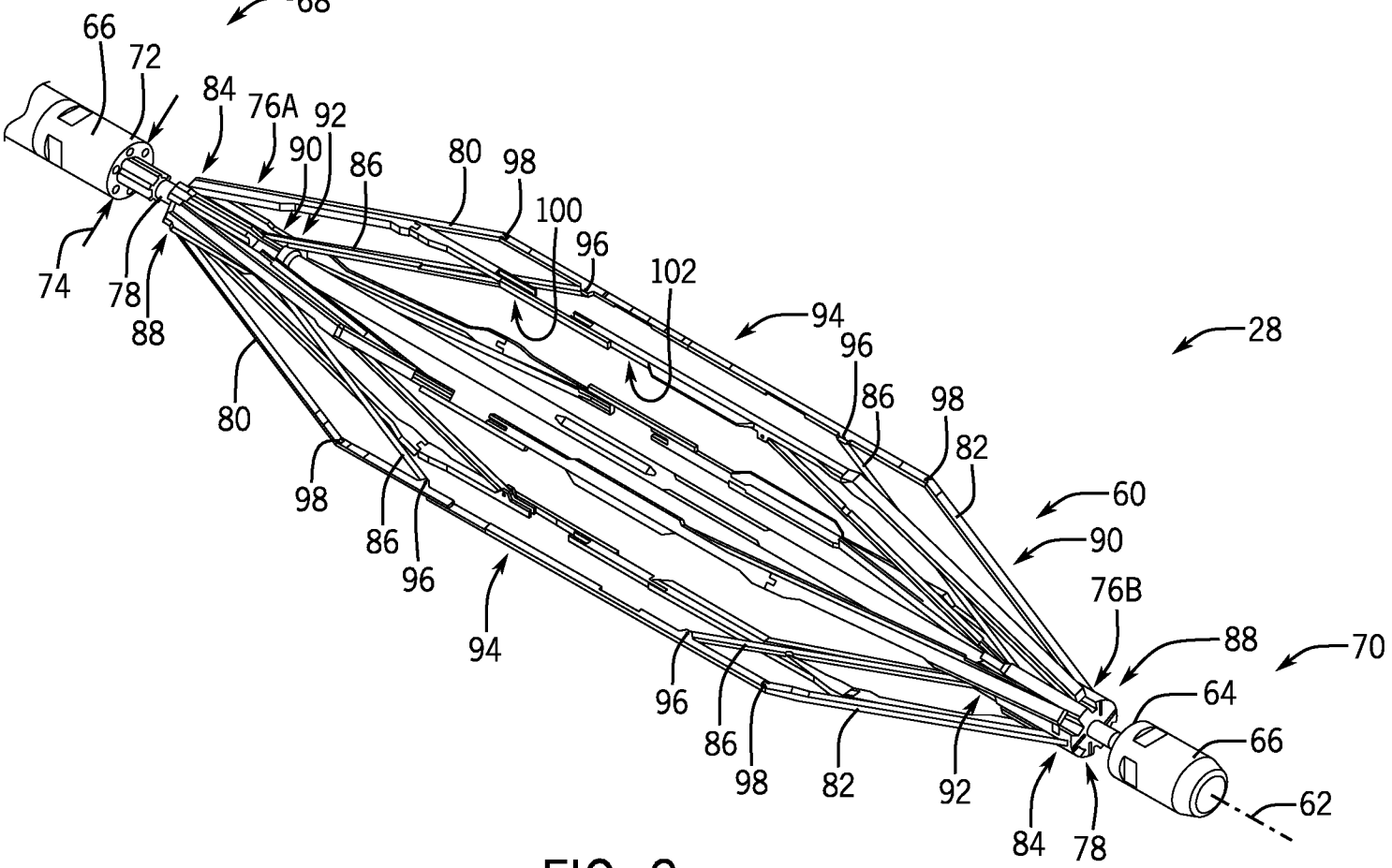
FIG. 2 is an isometric view of an embodiment of a downhole tool, in accordance with embodiments of the present disclosure.

FIG. 2 is an isometric perspective view of an embodiment of the downhole tool 28 including a plurality of extendable arms 60 (e.g., arms) arranged in an extended or deployed position. As illustrated in FIG. 2, the arms 60 are radially displaced from a tool string axis 62. The illustrated embodiment includes six arms 60, but it should be appreciated that in other embodiments more or fewer arms 60 may be included. For example, there may be one, two, three, four, five, ten, or any other reasonable number of arms 60 arranged on the downhole tool 28. In the illustrated embodiment, the arms 60 are arranged circumferentially about a circumference 64 of the tool 28 and are evenly spaced apart. However, in other embodiments, the arms 60 may not be evenly spaced apart. It should be appreciated that the spacing may be particularly selected based on anticipated downhole conditions. By arranging the arms 60 circumferentially about the downhole tool 28, the entire or substantially the entire annulus surrounding the downhole tool 28 may be analyzed using the arms 60 (e.g., using sensors coupled to the arms). Therefore, if flow at an upper portion were different than flow at a lower portion, for example, the different arms 60 would be arranged to monitor and report such flow characteristics to inform future wellbore activities. Furthermore, if fluid compositions were different along the annulus, the arrangement of the sensors circumferentially around the tool 28 may enable detection and measurement of the different fluid characteristics.

In various embodiments, a pair of bulkheads 66 are positioned at first and second ends 68, 70 of the downhole tool 28. For clarity with the discussion, the first end 68 may be referred to as the uphole side while the second end 70 may be referred to as the downhole side, however this terminology should not be construed as limiting as either end of the downhole tool 28 may be the uphole or downhole end and such arrangement may be determined by the orientation of the sensors coupled to the arms 60. Each of the illustrated bulkheads 66 include apertures 72 which may be utilized to route or otherwise direct cables coupled to the sensors arranged on the arms 60 into the tool body for information transmission to the surface 18, for example to the controller 40. It should be appreciated that each bulkhead 66 may include a predetermined number of apertures 72, which may be based at least in part on a diameter 74 of the downhole tool 28. Accordingly, embodiments of the present disclosure provide the advantage of enabling more sensors than traditional downhole expandable tools because of the presence of the pair of bulkheads 66. As will be described below, traditional tools may include a single bulkhead and a moving pivot block to facilitate expansion and contraction of arms for moving the sensors into the annulus. The end with the moving pivot block typically does not include a bulkhead due to the lateral movement of the pivot block along the tool string axis 62, which increases the likelihood that cables are damaged because of the increased movement.

In various embodiments, the one or more sensors may include flow sensors to measure speed of flow, composition sensors to determine the amount of gas or liquid in the flow, and/or resistivity sensors to determine the make of the flow (e.g., hydrocarbon or water). Additionally, these sensors are merely examples and additional sensors may be used. The bulkhead 66 may receive a sensor tube, cable, or wire coupled to the one or more sensors and includes electronics to analyze and/or transmit data received from the sensors to the surface. The illustrated bulkheads 66 are fixed. That is, the illustrated bulkheads 66 move axially with the downhole tool 28 and do not translate independently along the tool string axis 62. As a result, the cables coupled to the sensors may be subject to less movement and pulling, which may increase the lifespan of the cables.

FIG. 2 further illustrates a pair of pivot blocks 76 arranged on the downhole tool 28. In the illustrated embodiment, the pivot blocks 76 are positioned between the bulkheads 66. Further, each pivot block 76 of the pair of pivot blocks 76 is positioned proximate a respective bulkhead 66. That is, each of the pivot blocks 76 may be closer to one of the bulkheads 66. The pivot blocks 76 are coupled to the arms 60 at both ends to drive movement of the arms 60 between the illustrated expanded position, a stored position (not shown), and intermediate radial positions therebetween. The illustrated pivot blocks 76 include channels 78 to direct the sensor tube, cable, wire, or the like coupled to the one or more sensors toward the bulkhead 66, for example toward the aperture 72. It should be appreciated that, in various embodiments, there are an equal number of channels 78 and apertures 72. However, there may be more or fewer channels 78 and/or apertures 72. The illustrated pivot blocks 76 are fixed and do not move independently along the tool string axis 62. Rather, the pivot blocks 76 move with the tool string as the downhole tool 28 is inserted and removed from the wellbore 14. As described above, movement of the pivot blocks 76 in traditional systems may fatigue or position the cables such that damage may occur. However, providing a fixed position for the pivot blocks 76 protects the cables by reducing the amount of movement or flexion they may be exposed to.

The illustrated embodiment includes the arms 60 having a first segment 80 coupled to the pivot block 76A and a second segment 82 coupled to the pivot block 76B. The first and second segments 80 may be rotationally coupled to the respective pivot blocks 76 via a pin or journal coupling 84. However, pin and/or journal couplings are for illustrative purposes only and any reasonable coupling member to facilitate rotational movement of the first and second segments 80, 82 may be utilized. As will be described in detail below, rotational movement of the first and second segments 80, 82 move the arms 60 radially outward from the tool string axis 62. In various embodiments, a degree of relative motion of the first and second segments 80, 82 may be limited, for example by one or more restriction components, to block over-rotation of the first and second segments 80, 82. Furthermore, other components of the arms 60 may act to restrict the range of rotation of the first and second segments 80, 82.

The arms 60 further include a link arm 86, which is also coupled to the pivot block 76. As illustrated, the first and second segments 80, 82 are coupled to a respective far end 88 of the respective pivot block 76 while the link arm 86 is coupled to a respective near end 90 of the respective pivot block 76. The far end 88 is closer to the bulkhead head 66 than the near end 90. The link arm 86 is further coupled to the pivot block 76 via a pin or journal coupling 92, which may be a similar or different coupling than the coupling 84. The link arms 86 extend to couple to a telescoping section 94, for example via a pin or journal coupling 96. As illustrated, the first and second segments 80, 82 also coupling to the telescoping section 94, for example via a pin or journal coupling 98, at opposite ends.

It should be understood that, in various embodiments, the illustrated couplings between the first and second segments 80, 82, the link arms 86, the telescoping section 94, and/or the pivot block 76 may enable rotation about a respective axis. That is, the components may pivot or otherwise rotate relative to one another. In certain embodiments, the couplings may include pin connections to enable rotational movement. Furthermore, in certain embodiments, the components may include formed or machined components to couple the arms together while further enabling rotation, such as a rotary union or joint, sleeve coupling, or the like.

In the embodiment illustrated in FIG. 2 where the arms 60 are arranged in the expanded position, the combination of the first segment 80, the second segment 82, the link arms 86, and the telescoping section 94 generally form a parallelogram. As will be described in detail below, the telescoping section 94 includes a first section 100 and a second section 102 that are moveable relative to one another in response to rotation of the first and second segments 80 and/or link arms 86. In other words, the telescoping section 94 moves between an expanded position and a collapsed position based on the radial position of the arm 60 (e.g., one or more components of the arm 60).

In embodiments, properties of the arms 60, such as a length of the first segment 80, a length of the second segment 82, a length of the link arm 96, or a length of the telescoping section 94 may be particularly selected to control the radial position of the telescoping portion 94 with respect to the tool string axis 62. For example, the length of the first and second segments 80, 82 and the link arm 86 directly impact the radial position of the telescoping portion 94. In this manner, the position of the telescoping portion 94, and therefore the sensors coupled to the telescoping portion 94, may be designed prior to deploying the downhole tool 28. Furthermore, any number of sensors may be arranged on the arms. It should be appreciated that the sensors are not illustrated in FIG. 2 for clarity. In various embodiments, each arm 60 contains three sensors (e.g., flow, resistivity, composition), thereby performing a total of 18 different measurements with the illustrated downhole tool 28. The downhole tool 28 illustrated in FIG. 2 enables measurements at various locations in the annulus around the downhole tool 28, thereby providing information about flow characteristics at various circumferential positions in the annulus. As opposed to using multiple downhole tools over a vast length of a drill string, the illustrated downhole tool 28 measures and records flow conditions at a particular location in the wellbore 14 over substantially the entire annulus. In certain embodiments, the sensor tubes coupling the one or more sensors to the bulkheads 66 may be equally divided. In other embodiments, more or fewer sensor tubes may be coupled to one bulkhead 66.

FIGS. 3-8 depict various views of an embodiment of a bracket 120 for holding one or more sensors to the arms 60. In various embodiments, the bracket 120 is rotatably coupled to the arms 60 to thereby pivot relative to the arm 60 and move the sensors into a flow path, as will be described in detail below.

Figure 3:
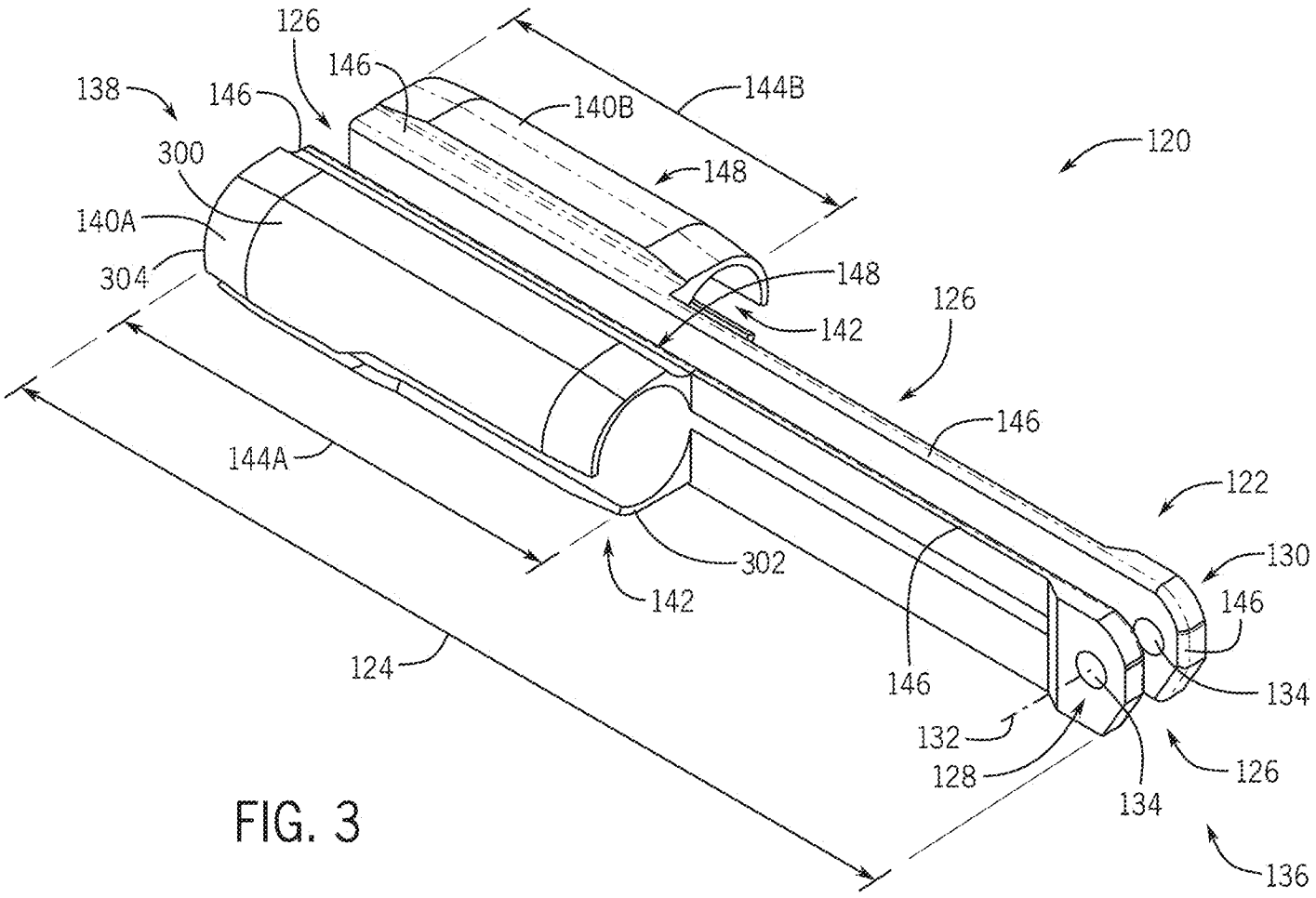
FIG. 3 a front isometric view of an embodiment of a bracket, in accordance with embodiments of the present disclosure.

FIG. 3 is a front isometric view of an embodiment of the bracket 120. The illustrated bracket 120 includes a spine 122 extending along a length 124 of the bracket 120. The spine 122 may provide structural rigidity to the bracket 120 for coupling to the arm 60. The illustrated spine 122 includes a gap 126 arranged between a first finger 128 and a second finger 130. In various embodiments, but not visible in FIG. 3, the first finger 128 and second finger 130 are coupled together. As will be described in detail below, the first and second fingers 128, 130 may include a varying thickness body portion that is particularly selected to reduce the weight of the bracket 120, enable multiple bracket 120 arrangements on the downhole tool 28, and provide sufficient strength to accommodate the wellbore environment.

In various embodiments, a pivot axis 132 extends through holes 134 formed through the first and second fingers 128, 130 at a first end 136 of the bracket 120. The first end 136 is arranged opposite the length 124 from the second end 138, which includes holsters 140. The illustrated embodiment includes a pair of holsters 140, however it should be appreciated that, in various embodiments, there may be more of fewer holsters 140. For example, there may be 1, 3, 4, 5, or any other reasonable number of holsters 140.

The illustrated holsters 140 are substantially cylindrical and include an opening 142 extending through an outer shell 300 of the holsters 140 to enable one or more sensors to be installed within the holsters 140. By way of example, the openings 142 may be particularly selected to accommodate sensor tubes that are coupled to the sensors. The tubes may be pressure containing housings that facilitate data transmission to the bulkhead 66. In the illustrated embodiment, the openings 142 extend along a length 144 of the holsters 140 from a first distal axial ends 302 and a second distal axial end 304. However, it should be appreciated that in various embodiments the openings 142 may not spend the entire length 144. Moreover, while the illustrated openings 142 are arranged along a side of the holsters 140, in other embodiments the openings 142 may be along a bottom, a top, or any other reasonable location of the holsters 140.

In the embodiment illustrated in FIG. 3, the holsters 140 are not the same size. That is, the length 144A for the holster 140A is longer than the length 144B for the holster 140B. The length 144 for the respective holsters 140 may be particularly selected based on the anticipated sensor to be arranged within the holster 140. In various embodiments, the lengths 144A, 144B may be equal. Moreover, in certain embodiments, the length 144B may be larger than the length 144A. Accordingly, it should be appreciated that the illustrated holsters 140A, 140B are for illustrative purposes only and are not intended to limit the disclosure.

In various embodiments, the holsters 140 may be biased toward the openings 142 in order to secure or clamp around the sensors installed therein. As a result, the holsters 140 will secure the sensors in place, even in the presence of wellbore conditions. In various embodiments, the bracket 120 is formed from a metal, plastic, composite material, or combination thereof. In certain embodiments, the bracket 120 may be a machined or cast piece. In certain embodiments, the bracket may be formed from manufacturing techniques, such as laser sintering of metal powder. Reducing the number of hard edges may ease manufacturing. Additionally, in other embodiments, the holsters 140 may be separately attached to the spine 122, for example via weld metal, fasteners, or any other reasonable method.

In various embodiments, the bracket 120 includes beveled edges 146 along various components of the bracket 120. For example, the first and second fingers 128, 130 include beveled edges 146 along the length 124. Furthermore, the holsters 140 include beveled edges 146 at respective coupling regions 148 where the holsters 140 are joined to the fingers 128, 130. It should be appreciated that the beveled edges 146 may improve flow characteristics of the bracket 120 without the annulus, thereby reducing turbulence at the sensors. Furthermore, the beveled edges 146 may improve the strength of the bracket 120 by distributing forces over a curved area, rather than a straight area.

Figure 4:
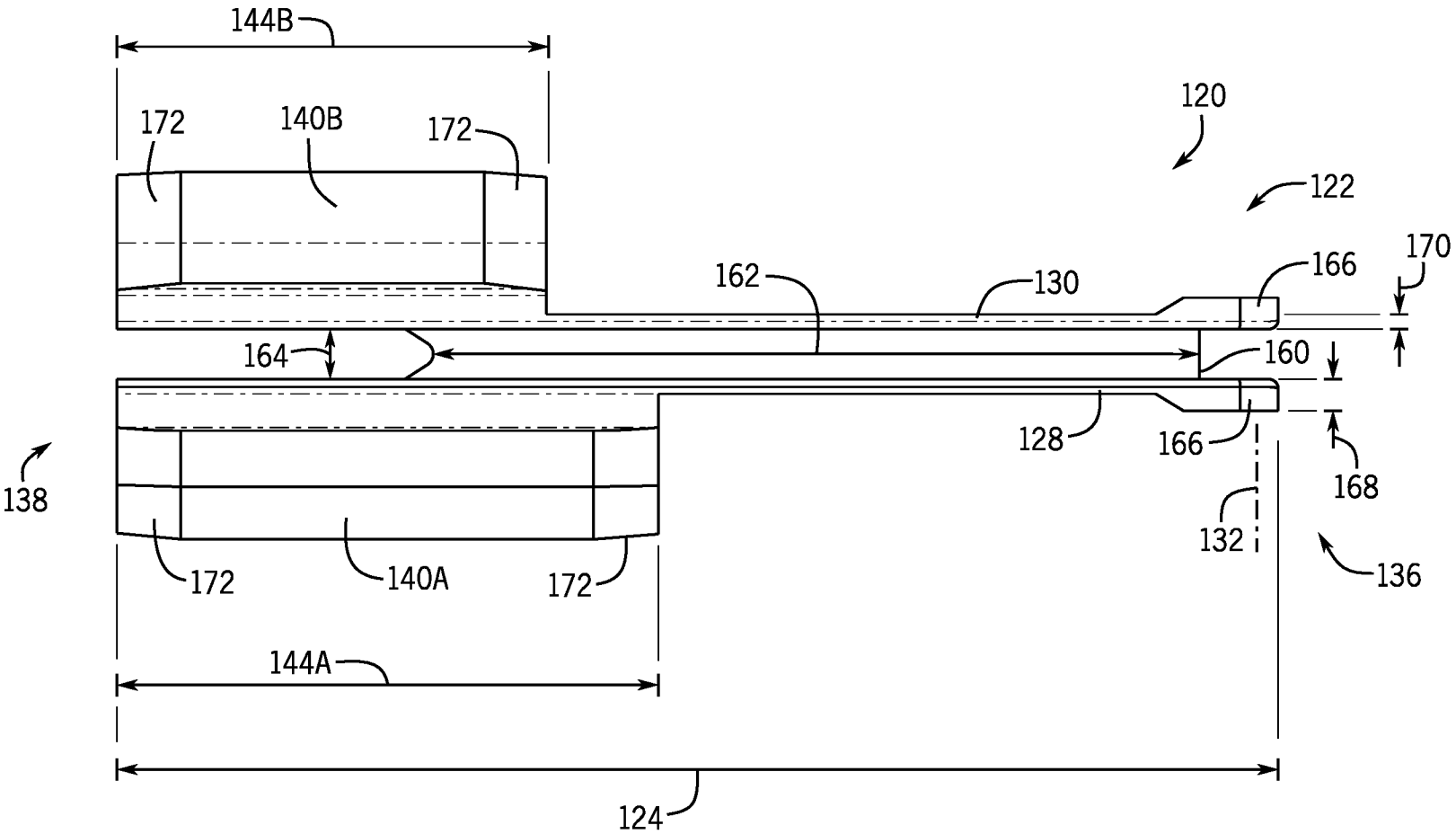
FIG. 4 is a top plan view of an embodiment of a bracket, in accordance with embodiments of the present disclosure.

FIG. 4 is a top plan view of an embodiment of the bracket 120. The illustrated embodiment includes a base 160 extending between the first and second fingers 128, 130, coupling them together. In the illustrated embodiment, a length 162 of the base 160 is less than the length 124 of the bracket 120. As a result, the weight of the bracket 120 may be reduced. In operation, the spine member 122 is arranged on the first segment 80, the second segment 82, the link arm 86, and/or the telescoping section 94. As such, the spine member 122 may facilitate in providing additional rigidity and strength to the arm 60. Furthermore, a width 164 of the base may be particularly selected to facilitate coupling the bracket 120 to the arm 60.

In the illustrated embodiment, the first end 136 includes the mounting heads 166. The mounting heads 166 include the holes 134 that extend therethrough. In the illustrated embodiment, a mounting head thickness 168 is larger than a finger thickness 170. Accordingly, there is additional rigidity and strength at the coupling point to the arm 60. It should be appreciated that the additional strength enables the bracket 120 to support the sensor within the flow path in wellbore conditions.

Further illustrated in FIG. 4 are chamfers 172 arranged along leading and trailing edges of the holsters 140. As described above, in various embodiments certain features, such as the beveled edges 146, may be incorporated into the bracket 120 to improve aerodynamics within the flow path. For example, the chamfers 172 reduce the cross-sectional flow area of the bracket 120, thereby reducing the likelihood of disturbing the flow in the annulus. It should be appreciated that the chamfers 172 may not be uniform on the leading and trailing edges. Additionally, each holster 140 may have different chamfers 172. In embodiments, a flow meter may be positioned proximate the bracket 120. By reducing the disturbance, the flow meter may measure more accurate characteristics of the flow.

The different lengths 144A, 144B of the respective holsters 140A, 140B are illustrated in FIG. 4. As described above, in various embodiments the lengths 144A, 144B may be particularly selected based on the type of sensors that will be arranged within the holsters 140A. As a result, different brackets 120 may be formed for certain sensors or sensor pairs, which simplifies installation procedures for operators.

Figure 5:
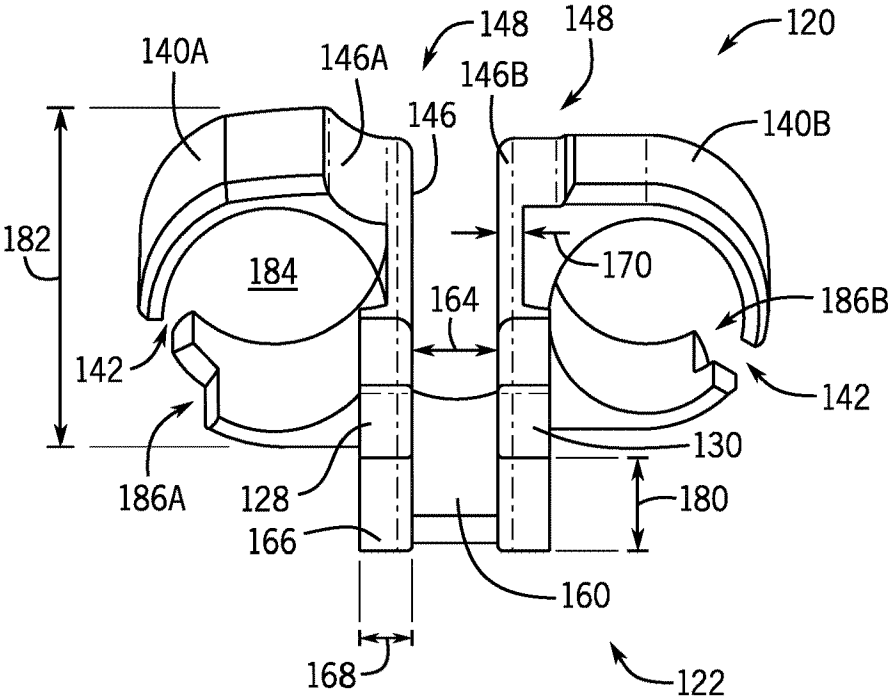
FIG. 5 is front isometric elevational view of an embodiment of a bracket, in accordance with embodiments of the present disclosure.

FIG. 5 is a front isometric elevational view of the bracket 120. As illustrated, the spine 122 is generally "U" shaped and includes the base 160 coupling the first finger 128 to the second finger 130. In the illustrated embodiment, the mounting heads 166 also include the beveled edges 146 that extend along the length 124. Furthermore, the beveled edges 146 are illustrated at the coupling regions 148. In the illustrated embodiment, the beveled edge 146A has a different radius than the beveled edge 146B. However, it should be appreciated that in other embodiments they may be the same.

In various embodiments, a height 180 of the spine 122 is less than a height 182 of the holsters 140. The various heights 180, 182 may be particularly selected based on design and operating conditions. For example, the height 182 of the holsters 140 may be at least partially dependent on the size and shape of the sensors. Furthermore, the height 180 of the spine 122 may be at least partially dependent on the size and shape of the arms 60.

The illustrated holsters 140 are substantially cylindrical with a void region 184 extending therethrough. The void region 184 receives the sensor. The illustrated holsters 140 includes notches 186 formed along a circumferential extend 188 of the holsters 140. In the illustrated embodiment, the holster 140A includes the notch 186A on the leading edge while the holster 140B includes the notch 186B on the trailing edge. It should be appreciated that, in other embodiments, the position of the notches may be swapped or may be the same. The respective notches 186 may facilitate installation and removal of the sensors by providing a region of flexion along the holsters 140.

Figure 6:
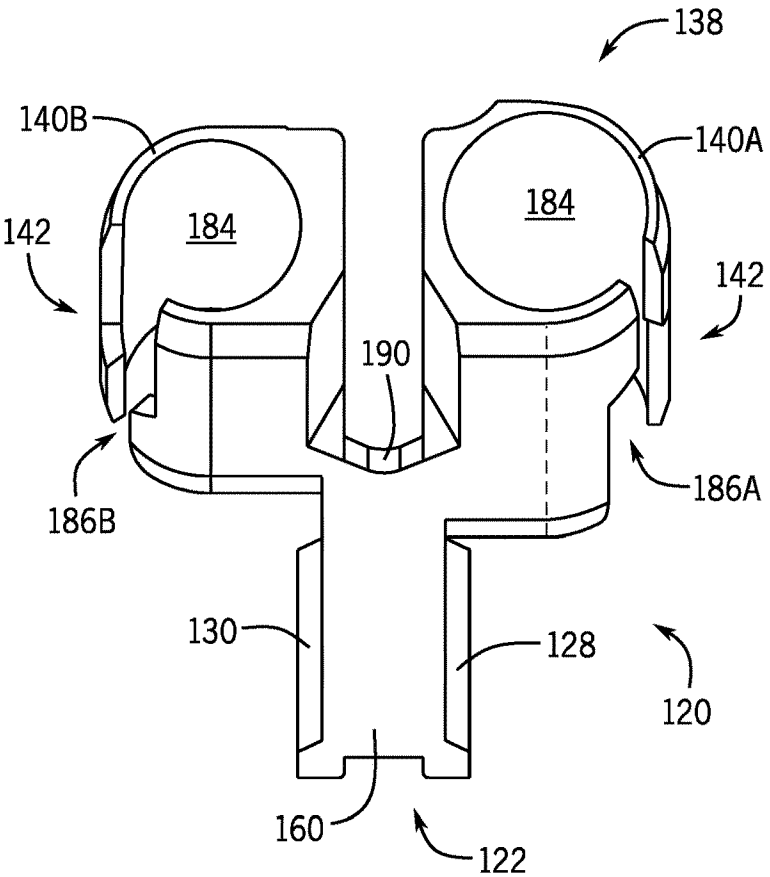
FIG. 6 is a bottom isometric view of an embodiment of a bracket, in accordance with embodiments of the present disclosure.

FIG. 6 is a rear isometric view of an embodiment of the bracket 120. As described above, the pair of holsters 140 are arranged at the second end 138 of the bracket 120. The illustrated base 160 ends substantially at the holsters 140, however it should be appreciated that in other embodiments the base 160 may extend to the end of the holsters 140. The illustrated base 160 further includes a bowed portion 190 for coupling to the holsters 140. As described above, in various embodiments transmitting forces along curved edges, rather than straight edges, may better distribute forces and improve the reliability and longevity of the bracket 120.

Figure 7:
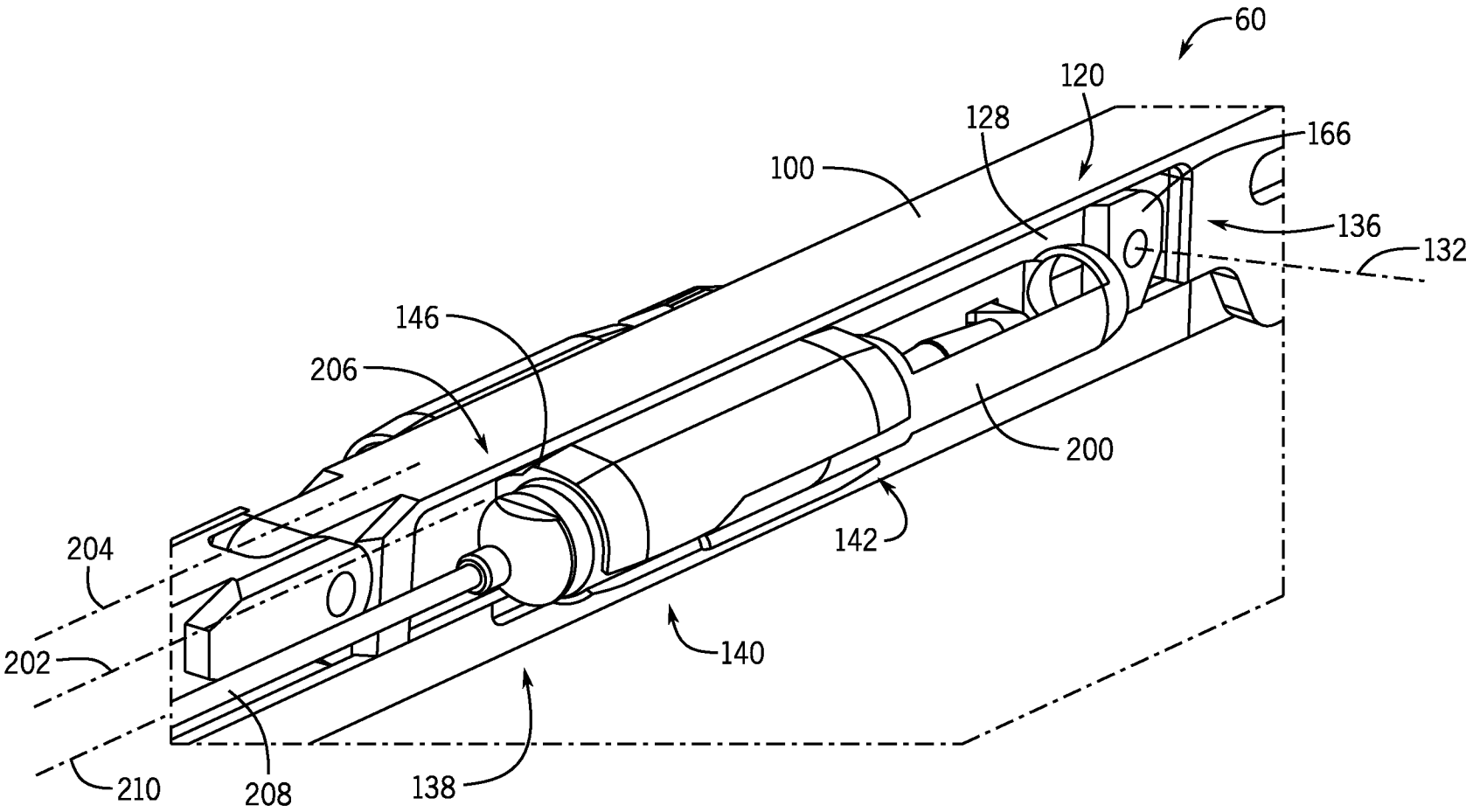
FIG. 7 is a rear perspective view of an embodiment of a bracket in a stowed position, in accordance with embodiments of the present disclosure.

FIG. 7 is a rear perspective view of an embodiment of the bracket 120 coupling a sensor 200 to the arm 60. The illustrated bracket 120 is in a stowed position such that a bracket axis 202 is substantially aligned with an arm axis 204. As illustrated, the bracket 120 is coupled to the arm 60 at the mounting head 166, for example via a pin or other coupling to enable rotation about the pivot axis 132. The first finger 128 is arranged within a recess 206 formed in the arm 60. In various embodiments, the recess 206 is sized to accommodate the first finger 128 (e.g., a depth of the recess is approximately equal to the finger thickness 170). The spine 122 extends around an under side of the arm 60 such that the second finger 130 is arranged on an opposite side of the arm 60. As such, the bracket 120 may be closely positioned to the arm 60. In various embodiments, the beveled edges 146 provide a gap or space between the arm 60 and the bracket 120, thereby reducing friction between the components.

The sensor 200 is arranged within the void region 184 and extends toward the first end 136. Furthermore, a sensor tube 208 extends from the second end 138. As described above, in various embodiments the opening 142 enables the sensor tube 208 to be threaded through the holster 140. For example, in operation, the sensor 200 may be installed from the leading end. First, the sensor tube 208 may be threaded through the opening 142 and then the sensor body is positioned within the holster 140. The sensor tube 208 may be routed to the bulkhead 66 for data transmission to the surface 18. As will be described below, as the arm 60 moves between the stored position and the deployed position, the sensor 200 may move axially along a holster axis 210, which may be substantially parallel to the bracket axis 202. In certain embodiments, the sensor 200 may have a freedom of axial movement of approximately 10 percent of the sensor length. However, it should be appreciated that the dimensions of the holster 140 may be particularly selected to allow axial movement of approximately 5 percent of the sensor length, approximately 15 percent of the sensor length, or any other reasonable percentage of the sensor length. Providing room for axial movement may reduce forces applied to the sensor tube 208, which may increase the longevity of the sensor tube and hence the reliability of data transfer to the bulkhead 66.

Figure 8:
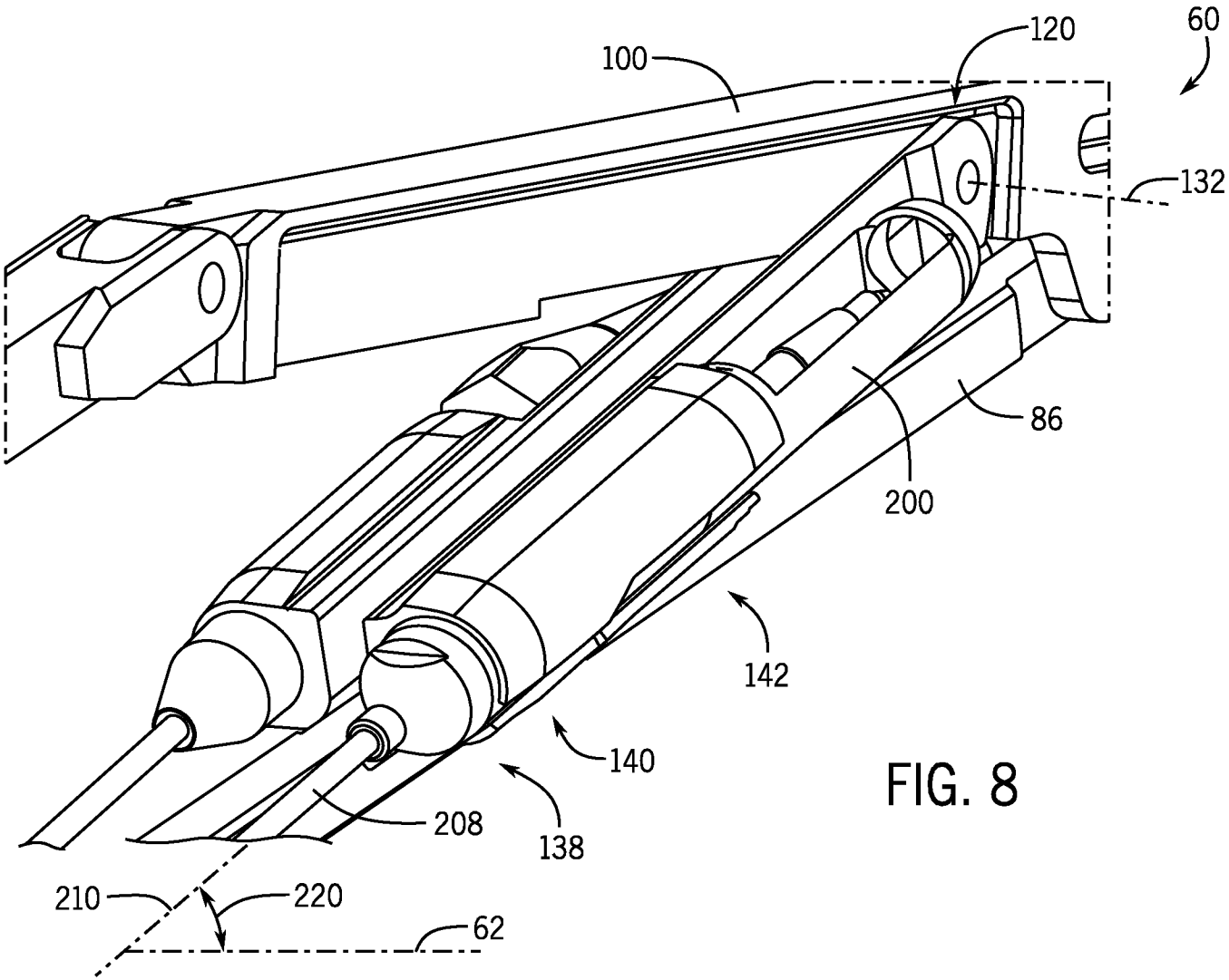
FIG. 8 is a rear perspective view of an embodiment of a bracket in a deployed position, in accordance with embodiments of the present disclosure.

FIG. 8 is a rear perspective view of the bracket 120 in the deployed position. In the illustrated embodiment, the bracket 120 is coupled to the telescoping section 94, for example to the first section 100, and rides or moves along with the link arm 86. That is, as the arm 60 transitions to the extended position the bracket 120 may drop such that the second end 138 moves radially inward toward the tool string axis 62. As a result, the sensors 200 are arranged within the flow path through the annulus. Movement of the bracket 120 is enabled via rotation about the pivot axis 132. As described above, in various embodiments the telescoping section 94 remains substantially parallel to the tool string axis 62 as the arm 60 moves to the extended position. In contrast, the holster axis 210 transitions such that it is arranged at an angle 220 relative to the tool string axis 62 when the bracket is in the deployed position.

In various embodiments, the bracket 120 may be coupled or otherwise arranged along the link arm 86 such that movement of the link arm 86 is substantially translated to the bracket 120. For example, the bracket 120 may move toward the deployed position as the link arm 86 moves toward the extended position and the bracket 120 may move toward the stowed position as the link arm 86 moves toward the stored position. In various embodiments, the chamfers, bevels, and other features may facilitate coupling or interaction between the various components. For example, the beveled edges 146 may guide the bracket 120 back into the stowed position.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A system for positioning a sensor within a flow path of a wellbore annulus, the system comprising:

a work string extending into the wellbore annulus from a surface location;

a movable arm on the work string, the movable arm transitioning between a first position at a first radial location and a second position at a second radial location, the first radial location being closer to a tool string axis than the second radial location;

a link arm directly coupled to the movable arm, the link arm being pivotable in response to movement of the movable arm; and a bracket coupled to the movable arm, the bracket being pivotable about a pivot axis substantially perpendicular to the tool string axis, wherein the bracket supports the sensor and transitions the sensor from a stored position to a deployed position when the movable arm moves to the second radial location, the bracket moving along with the link arm in response to movement of the movable arm.

2. The system of claim 1, wherein the bracket comprises:

a spine extending along at least a portion of a length of the bracket; and a holster coupled to the spine, the holster receiving and securing the sensor to the bracket.

3. The system of claim 2, wherein the holster comprises an opening extending along at least a portion of the holster length, the opening providing a pathway for a sensor tube coupled to the sensor.

4. The system of claim 2, further comprising a plurality of holsters coupled to the spine.

5. The system of claim 1, wherein the bracket comprises:

a mounting head at a first end having holes for coupling the bracket to the movable arm, the pivot axis extending through the holes; and a gap positioned between a pair of fingers, the gap having a first width that substantially corresponds to an arm width.

6. The system of claim 1, wherein the movable arm comprises a recess and the bracket is coupled to the movable arm at the recess.

7. The system of claim 1, wherein the bracket comprises at least one of a bevel, a chamfer, or a reduced diameter region to reduce turbulence in the flow path.

8. The system of claim 1, wherein the bracket is formed via a laser sintering process.

9. The system of claim 1, further comprising:

a telescoping section of the movable arm, wherein the sensor is mounted to the telescoping section at the pivot axis; and the link arm rotatably coupled to the telescoping section, wherein radial movement of the moveable arm induces rotation of the bracket about the pivot axis that substantially corresponds to rotational movement of the link arm relative to the telescoping section.

10. A system for mounting a sensor to an arm of a downhole tool, the system comprising:

a first finger comprising a first end to a second end;

a second finger extending from the first end to the second end and parallel to the first finger;

a base coupling the first finger to the second finger;

a holster coupled to at least one of the first finger or the second finger, the holster having a void region, extending entirely through a length of the holster such that the sensor is free of axial restrictions at a first distal axial end and a second distal axial end of the holster, for receiving at least a portion of the sensor and positioning the sensor along an axial holster axis extending between the first distal axial end and the second distal axial end, wherein the axial holster axis is parallel to the first finger;

a mounting head arranged at the first end of the first finger and the second finger, the mounting head having a mounting head thickness greater than a finger thickness of the first finger and the second finger, wherein the mounting head comprises an aperture for receiving a fastener to couple the first finger and the second finger to the arm; and a pivot axis extending through the aperture, wherein the holster is rotatable about the pivot axis, the pivot axis being perpendicular to the axial holster axis.

11. The system of claim 10, further comprising:

an opening extending along at least a portion of the length of the holster, the opening extending through an outer shell of the holster to provide access to and at least partially overlap the void region.

12. The system of claim 10, further comprising:

at least one of a beveled edge, a chamfer, or a reduced cross-sectional flow area arranged on at least one of the holster, the first finger, or the second finger.

13. The system of claim 10, further comprising:

a second holster coupled to the first finger or the second finger of the holster.

14. The system of claim 10, wherein at least one of the first finger, the second finger, or the holster is formed via a laser sintering process.

15. A system for securing a sensor to a downhole tool, the system comprising:

a moveable arm forming at least a portion of the downhole tool, the moveable arm being movable between a stored position at a first radial position and an extended position at a second radial position, wherein the first radial position is closer to a tool string axis than the second radial position; and a bracket secured to the moveable arm at a pivot axis, the bracket being rotatable about the pivot axis between a first bracket position and a second bracket position, the bracket comprising a holster having a void region for receiving the sensor, the holster positioning the sensor along a holster axis;

wherein the holster axis is substantially parallel to the tool string axis when the holster is in the first bracket position, and the holster axis is arranged at an angle relative to the tool string axis when the holster is in the second bracket position, the first bracket position and second bracket position being at different angles, the bracket is nesting around a link arm; when in the second position, the link arm is arranged at a second angle different from the angle of the holster axis.

16. The system of claim 15, further comprising:

a recess formed in the moveable arm, wherein the bracket is secured to the moveable arm at the recess.

17. The system of claim 15, further comprising:

an opening formed in a sidewall of the holster, the opening extending along at least a portion of a length of the holster.

18. The system of claim 15, further comprising:

a mounting head positioned at an end of the bracket opposite the holster, the mounting head having a mounting head thickness greater than a bracket thickness proximate the mounting head.

19. The system of claim 15, wherein the bracket is formed via a laser sintering process.

* * * * *